US011302465B2

(12) United States Patent
Hashimoto et al.

(10) Patent No.: US 11,302,465 B2
(45) **Date of Patent: *Apr. 12, 2022**

(54) RARE-EARTH PERMANENT MAGNET

(71) Applicant: TDK CORPORATION, Tokyo (JP)

(72) Inventors: Ryuji Hashimoto, Tokyo (JP); Masashi Ito, Tokyo (JP); Eiichiro Fukuchi, Tokyo (JP); Yuki Nagamine, Tokyo (JP)

(73) Assignee: TDK CORPORATION, Tokyo (JP)

( * ) Notice: Subject to any disclaimer, the term of this patent is extended or adjusted under 35 U.S.C. 154(b) by 322 days.

This patent is subject to a terminal disclaimer.

(21) Appl. No.: 16/465,412

(22) PCT Filed: Nov. 30, 2017

(86) PCT No.: PCT/JP2017/043076

§ 371 (c)(1),
(2) Date: Aug. 20, 2019

(87) PCT Pub. No.: WO2018/101410

PCT Pub. Date: Jun. 7, 2018

(65) Prior Publication Data

US 2020/0020468 A1 Jan. 16, 2020

(30) Foreign Application Priority Data

Nov. 30, 2016 (JP) ..... JP2016-232113
Mar. 13, 2017 (JP) ..... JP2017-047923

(51) Int. Cl.
*H01F 1/057* (2006.01)
*C22C 38/10* (2006.01)

(52) U.S. Cl.
CPC ..... *H01F 1/0577* (2013.01); *C22C 38/10* (2013.01)

(58) Field of Classification Search
None
See application file for complete search history.

(56) References Cited

U.S. PATENT DOCUMENTS 10,886,044 B2 * 1/2021 Ito ..... C22C 38/005
2016/0276075 A1 9/2016 Ito et al.
2019/0333660 A1 * 10/2019 Ito ..... C22C 33/02
2020/0005973 A1 * 1/2020 Iwasa ..... C22C 38/10

FOREIGN PATENT DOCUMENTS

CN 105989983 A 10/2016
JP 2008-133496 A 6/2008

OTHER PUBLICATIONS

Machine translation of JP 2008-133496A. (Year: 2008).*
Huang, J. Appl. Phys., vol. 73, p. 5902-5904. (Year: 1993).*
Saito et al., Materials Science and Engineering, vol. 1, No. 1. 012032, pp. 1-6, 2009.
Feb. 27, 2018 International Search Report issued in International Patent Application No. PCT/JP2017/043076.

* cited by examiner

*Primary Examiner* — Xiaowei Su
(74) *Attorney, Agent, or Firm* — Oliff PLC

(57) ABSTRACT

To provide a rare earth permanent magnet having as a main phase a compound with a $Nd_5Fe_{17}$ crystalline structure having strong coercive force. A rare earth permanent magnet having as a main phase a compound with a $Nd_5Fe_{17}$ crystalline structure, wherein when the composition ratio of the rare earth permanent magnet is expressed as $R_aT_{(100-a-b)}C_b$, where R is one or more rare earth elements requiring Sm, and T is one or more transition metal elements requiring Fe or Fe and Co, a and b satisfy $18<a<40$ and $0.5\leq b$, and a phase where R and C are denser than the main phase is provided in the grain boundary phase of the rare earth permanent magnet.

2 Claims, No Drawings

RARE-EARTH PERMANENT MAGNET

BACKGROUND OF THE INVENTION

The present invention relates to a rare-earth permanent magnet including a compound having an $Nd_5Fe_{17}$ type crystal structure as a main phase.

An R-T-B based permanent magnet as a representative example of a high-performance permanent magnet is increased in production volume year by year due to high magnetic properties, and it is widely used for various motors, various actuators, MRI devices, and the like. Here, R is a rare-earth element, T is Fe or a combination of Fe and Co, and B is boron.

Since such R-T-B based permanent magnet has been developed, research of permanent magnets has been mainly focused on trying to find a new intermetallic compound of rare-earth metals. Among these, a permanent magnet material having a $Sm_5Fe_{17}$ intermetallic compound as a main phase as described in Patent Document 1 attains extremely high coercivity of 36.8 kOe at room temperature. Therefore, the permanent magnet material described in Patent Document 1 having the $Sm_5Fe_{17}$ intermetallic compound as a main phase is considered as a promising permanent magnet material.

However, in regards with the permanent magnet having the $Sm_5Fe_{17}$ intermetallic compound as the main phase, technique to control grain boundary phases has not been established, and a permanent magnet utilizing the high coercivity of the permanent magnet material having the $Sm_5Fe_{17}$ intermetallic compound as the main phase is still not realized.

Non-Patent Document 1 describes a permanent magnet using Spark Plasma Sintering (SPS) method. However, this permanent magnet does not attain a coercivity as high as a coercivity of the material powder. A possible reason for this is because grain boundary phases of the permanent magnet are not controlled sufficiently and a magnetic separation between main phase grains are not enough. Also, there is a possibility that the coercivity of the entire magnet is decreased due to the presence of sub-phases of a low coercivity component such as a $SmFe_2$ phase, a $SmFe_3$ phase, and the like.

[Patent Document 1] JP Patent Application Laid Open No. 2008-133496

[Non-Patent Document 1] Materials Science and Engineering 1 (2009) 012032

BRIEF SUMMARY OF THE INVENTION

The present invention was attained in view of such circumstances, and the object is to improve a coercivity of a rare-earth permanent magnet including a compound having an $Nd_5Fe_{17}$ type crystal structure as a main phase.

The present invention is a rare-earth permanent magnet including a main phase having an $Nd_5Fe_{17}$ type crystal structure, wherein R is essentially Sm or is at least one selected from rare earth elements in addition to Sm, T is essentially Fe or a combination of Fe and Co or is at least one selected from transition metal elements in addition to Fe or the combination of Fe and Co, a compositional ratio of the rare-earth permanent magnet is represented by $R_aT_{(100-a-b)}C_b$ in which "a" and "b" satisfy $18<a<40$ and $0.5\leq b$, and a phase having higher concentration of R and C compared to the main phase is included in grain boundary phases of the rare-earth permanent magnet.

Also, in the above mentioned rare-earth permanent magnet, "b" may be $1.0<b<15.0$.

Further, in above mentioned rare-earth permanent magnet, $c1<3.0$ at % and $c2-c1>10.0$ at % may be satisfied in which c1 (at %) represents a compositional ratio of C in the main phase and c2 (at %) represents a compositional ratio of C in the phase having higher concentration of R and C compared to the main phase.

The present inventors have found that the coercivity of the rare-earth permanent magnet including the main phase having the $Nd_5Fe_{17}$ type crystal structure can be improved by forming a grain boundary phase having higher concentration of R and C compared to the main phase in grain boundary phases. Reason for the improvement of the coercivity is not clear, and the present inventors speculate that due to the grain boundary phase having higher concentration of R and C compared to the main phase, the magnetic separation of the main phase grains may have increased. Note that, the $Nd_5Fe_{17}$ type crystal structure refers to a same type of crystal structure as a crystal structure of the $Nd_5Fe_{17}$ intermetallic compound. Also, R is not necessarily limited to Nd and T is not necessarily limited to Fe.

According to the present invention, the coercivity of the rare-earth permanent magnet including a compound having the $Nd_5Fe_{17}$ type crystal structure as a main phase can be improved.

DETAILED DESCRIPTION OF THE INVENTION

Hereinafter, embodiments for carrying out the present invention are described in detail. Note that, the present invention is not to be limited to a context described in below embodiments. A constituting element of the below described embodiments includes those one ordinary skilled in the art can easily attain, those which are substantially the same, and those which are in so called equivalent range. Further, the constituting element described in below embodiments can be combined accordingly.

The rare-earth permanent magnet according to the present embodiment includes a compound having an $Nd_5Fe_{17}$ type crystal structure (a space group $P6_3/mcm$) as the main phase. Here, the main phase refers to a crystal phase having largest volume ratio in the permanent magnet. Hereinafter, a phase having an $Nd_5Fe_{17}$ type crystal structure is referred as an $R_5T_{17}$ phase.

In the rare-earth permanent magnet according to the present embodiment, R is essentially Sm or is at least one selected from rare earth elements in addition to Sm. The rare-earth elements are Sm, Y, La, Pr, Ce, Nd, Eu, Gd, Tb, Dy, Ho, Er, Tm, Yb, and Lu. The larger the ratio of Sm in the entire rare-earth elements is, the more preferable it is; and Sm atomic ratio is preferably 50 at % or more with respect to the entire rare-earth element amount of the entire rare-earth permanent magnet.

In case Pr and/or Nd are included as the rare-earth elements, a residual magnetization tends to improve since effective magnetic moments of Pr and Nd are larger than Sm. Note that, if a ratio of Pr and Nd in the entire rare-earth elements is too large, a crystal magnetic anisotropy of the $R_5T_{17}$ crystal phase decreases and also different phases which are low coercivity component tend to be easily formed, thus the coercivity decreases. An atomic ratio of total of Pr and Nd only needs to be less than 50 at % of the entire rare-earth element amount, and preferably it is less than 25 at %.

A compositional ratio of R in the rare-earth permanent magnet according to the present embodiment is more than 18 at % and less than 40 at %. When the compositional ratio of R is 18 at % or less, it is difficult to obtain the $R_5T_{17}$ crystal phase and many α-Fe crystal phases are generated, thus the coercivity significantly decreases. On the other hand, when the compositional ratio of R is 40 at % or more, large amount of low coercivity component such as an $RT_2$ crystal phase deposits, thus the coercivity significantly decreases.

In the rare-earth permanent magnet according to the present embodiment, T is essentially Fe or a combination of Fe and Co or is at least one selected from transition metal elements in addition to Fe or the combination of Fe and Co. Co content in the entire rare-earth permanent magnet is preferably 20 at % or less with respect to the entire transition metal elements of the entire rare-earth permanent magnet. By selecting appropriate Co amount, a saturated magnetization can be improved. Also, by increasing Co amount, a corrosion resistance of the permanent magnet can be improved.

In the rare-earth permanent magnet according to the present embodiment, the main phase is the $R_5T_{17}$ crystal phase. The $R_5T_{17}$ crystal phase has a high anisotropic magnetic field due to its complicate crystal structure. Also, phases other than the main phase are considered grain boundary phases.

In the rare-earth permanent magnet according to the present embodiment, a phase having higher concentration of R and C compared to the main phase is in the grain boundary phases. As other grain boundary phases, an R-rich phase, an $RT_2$ phase, an $RT_3$ phase, and the like which are seen in conventional $R_5T_{17}$ intermetallic compound may exist.

The grain boundary phase having higher concentration of R and C compared to the main phase is an $R_3C$ phase, an $R_2C_3$ phase, an $RC_2$ phase, and R-T-C compound phase of amorphous or micro-crystalline state. The $R_3C$ phase, the $R_2C_3$ phase, and the $RC_2$ phase are non-magnetic phases, and a magnetic separation between main phase grains can be improved. The R-T-C compound phase of amorphous or micro-crystalline state is a magnetic phase, but as long as C is not included, the low coercivity component such as the $RT_2$ phase, the $RT_3$ phase, and the like is formed. Therefore, in case of including the R-T-C compound phase of amorphous or micro-crystalline state, the magnetic properties are decreased, and the magnetic separation between the main phase grains can be improved compared to the case of not including C. Note that, the grain boundary phase having higher concentration of R and C compared to the main phase may include further other elements.

The higher the ratio of the grain boundary phase having higher concentration of R and C compared to the main phase in the entire grain boundary phases is, the more preferable it is. Also, the grain boundary phase having higher concentration of R and C compared to the main phase is preferably positioned in a grain boundary between two grains and preferably covers the main phase grains.

In the rare-earth permanent magnet according to the present embodiment, the compositional ratio of C needs to be 0.5 at % or more. In case the compositional ratio of C is less than 0.5 at %, the grain boundary phase having higher concentration of R and C compared to the main phase cannot be formed, and the effect of improving the coercivity cannot be obtained. The compositional ratio of C is particularly preferably larger than 1.0 at % and less than 15.0 at %. By having the compositional ratio of C larger than 1.0 at %, the ratio of the grain boundary phase having higher concentration of R and C compared to the main phase increases in the entire grain boundary phases, and a particularly high coercivity can be attained. Also, by having the compositional ratio of C less than 15.0 at %, a ratio of the grain boundary phase having higher concentration of R and C compared to the main phase is within the appropriate range with respect to the main phase, and a particularly high coercivity can be attained. Further, the compositional ratio of C is more particular preferably within the range of 2.0 at % or more and 7.5 at % or less.

In the rare-earth permanent magnet according to the present embodiment, the compositional ratio of C in the main phase is less than 3.0 at %, and the difference between the compositional ratio of C in the grain boundary phase having higher concentration of R and C compared to the main phase is preferably larger than 10 at %. By having less than 3 at % of the compositional ratio of C in the main phase, the magnetic anisotropy of the main phase can be suppressed from decreasing. The compositional ratio of C in the main phase is particularly preferably less than 1.0 at %. As the difference between the compositional ratio of C in the grain boundary phase having higher concentration of R and C compared to the main phase is larger than 10 at %, in addition to the effect of magnetic separation between the main phase grains, an effect of pinning a magnetic domain wall movement in the grain boundaries can be attained, thus further higher coercivity can be attained.

The rare-earth permanent magnet according to the present embodiment may include other elements besides the above mentioned elements. For example, Bi, Sn, Ga, Si, Ge, Zn, and the like can be included accordingly. Also, the rare-earth permanent magnet may include impurities derived from raw materials.

Hereinafter, preferable example of a method of producing the present invention is described.

The method of producing the rare-earth permanent magnet may be a sintering method, an ultra-rapid solidification method, a vapor deposition method, HDDR method, and the like and as an example of the method of producing using an ultra-rapid solidification method is described.

Specifically, an ultra-rapid solidification method includes a single roller method, a double roller method, a centrifugal quenching method, a gas atomization method, and the like. Among these, a single roller method is preferably used. In a single roller method, a molten alloy is discharged from a nozzle and the molten alloy collides against a circumference face of a quenching roller to rapidly cool the molten alloy, thereby a quenched alloy of thin ribbon or thin piece is obtained. A single roller method has higher productivity and has good reproducibility of a quenching condition compared to other ultra-rapid solidification methods.

As a raw material, an alloy ingot of an R-T-C alloy having desired compositional ratio is prepared. The raw material alloy can be produced by arc melting the raw materials of R, T, and C in inert gas preferably in Ar atmosphere, or also by other known melting method. In case of including other elements such as Bi, Sn, Ga, Si, Ge, Zn, and the like, these can be included by a melting method as similar to mentioned in above.

From the alloy ingot of the R-T-C alloy produced by the above method, amorphous alloy is produced by an ultra-rapid solidification method. As an ultra-rapid solidification method, a melt spinning method is preferable in which the above mentioned alloy ingot is broken into pieces by a stamp mill and the like, and high frequency melting is carried out in Ar atmosphere, then the molten alloy is ejected onto a copper roller which is rotating in high speed, thereby rapid solidification is done. The molten alloy which has been quenched by the roller becomes a quenched alloy of thin ribbon form by rapid solidification.

The quenched alloy is either one type of an amorphous phase, a mixed phase of amorphous phase and crystal phase, and a crystal phase depending on the compositional ratio and a circumferential speed of the quenching roller. The amorphous phase is micro-crystallized by crystallization treatment carried out later on. As one standard, the faster the circumferential speed of the quenching roller is, the higher the ratio of the amorphous phase is.

The faster the circumferential speed of the quenching roller is, the thinner the obtained quenched alloy becomes, and thus even more uniform quenched alloy can be obtained. After obtaining the amorphous phase structure, by performing appropriate crystallization treatment, the $R_5T_{17}$ crystal phase can be obtained. Therefore, the preferable embodiment of the quenched alloy according to the present embodiment is to obtain an amorphous phase or a mixed phase of amorphous phase and $R_5T_{17}$ crystal phase. In order to attain this, the circumferential speed of the quenching roller is usually 10 m/s or faster and 100 m/s or slower, preferably 20 m/s or faster and 85 m/s or slower, and even more preferably 30 m/s or faster and 75 m/s or slower. When the circumferential speed of the quenching roller is slower than 10 m/s, uniform alloy cannot be obtained, and the desired crystal phase is difficult to obtain. When the circumferential speed of the quenching roller is faster than 100 m/s, the adhesiveness between the molten alloy and the quenching roller is degraded and a heat transfer cannot be done efficiently.

Next, the quenched alloy is subjected to a crystallization treatment. The crystallization treatment is done by increasing the temperature at a heating rate of 0.01° C./s or faster and 30° C./s or slower until it reaches a crystallization treatment temperature which is between 500° C. or higher and 700° C. or lower, then the temperature is maintained at the crystallization treatment temperature for 0.5 minutes or longer to 5000 minutes or shorter. Usually, the crystallization treatment is done under Ar atmosphere.

The R-T-C alloy obtained by the crystallization treatment is subjected to a pulverization step. The pulverization step includes a coarse pulverization step and a fine pulverization step. First, the raw material alloy is coarsely pulverized until a particle size becomes several hundred μm. The coarse pulverization is preferably carried out using a stamp mill, a jaw crasher, a brown mill, and the like under inert gas atmosphere. Prior to the coarse pulverization, it is effective to carry out the pulverization by storing hydrogen to the raw material alloy and then dehydrogenating the alloy. A dehydrogenation treatment is performed to decrease hydrogen which becomes impurity for the rare-earth permanent magnet.

A heat holding temperature for dehydrogenation is 200° C. or higher and preferably 350° C. or higher. A heat holding time differs depending on the holding temperature and the thickness of the raw material alloy, and it is at least 30 minutes or longer, and preferably 1 hour or longer. The dehydrogenation treatment is done in vacuumed atmosphere or in Ar gas flow. Note that, this hydrogen absorption treatment and dehydrogenation treatment are not necessary steps. Also, the hydrogen pulverization (hydrogen absorption treatment and dehydrogenation treatment) may be considered as the coarse pulverization, and a mechanical coarse pulverization may be omitted.

After the coarse pulverization step, a fine pulverization step is done. For the fine pulverization, a jet mill is mainly used, and the coarsely pulverized powder is formed into finely pulverized powder by fine pulverization. A jet mill discharges high pressured inert gas from a narrow nozzle to produce high speed gas, the coarsely pulverized powder is accelerated by this high speed gas, and pulverization is done by making the coarsely pulverized powder collide with each other and also by making the powder collide against a target or a chamber wall. For the fine pulverization, a wet pulverization may be used. For a wet pulverization, a ball mill, a wet attritor, and the like may be used.

The finely pulverized powder is subjected to a molding step. The molding step is done by applying pressure of 30 MPa or more and 300 MPa or less. The pressure during the molding step may be constant from start to end of molding, pressure may gradually increase or decrease or pressure may change in irregular manner. The lower the pressure is, the better the orientation is, but if the pressure is too low, the strength of the green compact may become insufficient and it may become difficult to handle. Therefore, the pressure is selected from the range described above by taking this point into consideration.

During the molding step, a crystal axis is oriented in one direction by applying a magnetic field, thereby the anisotropic rare-earth permanent having high residual magnetic density can be obtained. The applied magnetic field is not limited to a static magnetic field, and it may be a pulse magnetic field. Also, a static magnetic field and a pulse magnetic field may be used together.

The green compact is subjected to a sintering step. A sintering holding temperature and a sintering holding time needs to be adjusted depending on various conditions such as a composition, a pulverization method, a difference between an average grain size and grain size distribution, a sintering method, and the like. Particularly, when the sintering holding temperature is 700° C. or higher, the $R_5T_{17}$ crystal phase partially decomposes and the coercivity tends to decrease, thus as the sintering method, SPS method is preferable which allows low temperature sintering.

In order to form the grain boundary phase having higher concentration of R and C compared to the main phase, a heat treatment after the sintering step is effective. This heat treatment is done by increasing the temperature at a heating rate of 10° C./s or faster and 30° C./s or slower to the heat treatment temperature of 500° C. or higher and 650° C. or lower, then the heat treatment temperature is maintained for 10 minutes or longer and 50 minutes or less. Usually, this treatment is performed in Ar atmosphere. As such, by heat treating at a temperature which does not decompose the $R_5T_{17}$ crystal phase, atoms diffuse through the grain boundary phases, and the ratio of the grain boundary phase having higher concentration of R and C compared to the main phase with respect to the entire grain boundary phases increases. Also, the grain boundary phase having higher concentration of R and C compared to the main phase spreads through the grain boundaries between two grains, thus a covering ratio against the main phase grain increases.

In order to form the difference between the compositional ratio of C in the main phase and the compositional ratio of C in the grain boundary phase having higher concentration of R and C compared to the main phase by lowering the compositional ratio of C in the main phase compared to the compositional ratio of C of the rare-earth permanent magnet according to the present embodiment, it is possible to select a method of producing the rare-earth permanent magnet by producing an R-T-C alloy having low compositional ratio of C and an R-T-C alloy having high compositional ratio of C and then mixing these during the fine pulverization step. Particularly, by using an R-T alloy which does not substantially include C as the R-T-C alloy having low compositional ratio of C, the compositional ratio of C in the main phase can be maintained low, while widening the difference between the compositional ratio of C in the grain boundary phases having higher concentration of R and C compared to the main phase. The condition of production of an ultra-rapid solidification method and the condition of the crystallization treatment may be adjusted depending on each alloy with different composition.

Hereinabove, the embodiment regarding the method of production of the preferable embodiment to carry out the present invention was described, and next a method of evaluating and analyzing the rare-earth permanent magnet of the present invention is described.

For analyzing generated phases of a sample, X-ray Diffractometry (XRD) is used. Also, for analyzing the compositional ratio of entire sample, Iductively Coupled Plasma (ICP) Mass Spectrometry and oxygen stream combustion-infrared absorption method are used.

Next, a method of analyzing the compositional ratio of the main phase and the grain boundary phases is described. A cross section of the sample processed by Focused Ion Beam (FIB) is observed using Scanning Transmission Electron Microscope (STEM). STEM uses Energy Dispersive Spectroscopy (EDS). A compositional mapping is done by EDS, and the main phase, the grain boundary phases, and the phase in the grain boundary phases having higher concentration of R and C compared to the main phase are categorized. For the main phase and the grain boundary phases, the phases having R and T ratio of about 5:17 is considered the main phase. Other phases besides the main phase are considered as the grain boundary phases. By observing the compositional ratio of R, C, and other elements beside R and C, the phases having higher concentration of R and C compared to the main phase and other phases besides this can be categorized. After categorizing each phase, a point analysis is carried out to the main phase and the grain boundary phase having higher concentration of R and C compared to the main phase; and the compositional ratio of the main phase and the grain boundary phase having higher concentration of R and C can be calculated.

For measuring the magnetic properties of the sample, a BH tracer is used.

EXAMPLES

Hereinafter, the present invention is described in detail using examples and comparative examples, but the present invention is not to be limited thereto.

A rare-earth permanent magnet according to Example 1 is described. Sm, Fe, and C were blended so that the rare-earth permanent magnet satisfied the composition shown in Table 1, and an R-T-C alloy ingot was produced by arc melting in Ar atmosphere, then broken into pieces using a stamp mill. These small pieces were high frequency melted in Ar atmosphere, and it was quenched using a single roller method at a circumferential speed of 40 m/s, thereby a quenched alloy was obtained. The obtained quenched alloy was subjected to crystallization treatment at 620° C. in Ar atmosphere for 30 minutes. After the crystallization treatment, an R-T-C alloy was subjected to a coarse pulverization using a stamp mill and a fine pulverization using a ball mill. After molding an R-T-C finely pulverized powder, sintering was carried out using SPS method at a sintering holding temperature of 620° C. for a sintering holding time of 5 minutes. After a sintering step, a heat treatment was carried out at 550° C. for 60 minutes; thereby the rare-earth permanent magnet was made. Note that, a heating rate until reaching 550° C. was 20° C./s.

The main phase of the sample was determined using XRD and STEM-EDS. A cross section of the sample processed using FIB was measured using STEM-EDS. The compositional ratio of the entire sample was calculated using ICP mass spectrometry and oxygen stream combustion-infrared absorption method. A compositional ratio of a main phase and a compositional ratio of a grain boundary phase having higher concentration of R and C compared to the main phase were evaluated by STEM-EDS. First, using a compositional mapping, the main phase, the grain boundary phases, and the phase in the grain boundary phases having higher concentration of R and C compared to the main phase were determined. Then, fifty main phases and fifty grain boundary phases having higher concentration of R and C compared to the main phase were selected, and a point analysis was carried out to calculate an average value which was defined as the compositional ratio.

As the magnetic properties of the sample, a coercivity was obtained from a magnetization curve having a maximum magnetic field±100 kOe using a BH tracer.

For Examples 1 to 11 and Comparative examples 1 to 4, a compositional ratio of an entire rare-earth permanent magnet, a compositional ratio of the main phase, a compositional ratio of the grain boundary phase having higher concentration of R and C compared to the main phase, and a coercivity are shown in Table 1. Also, regarding the compositional ratio of the entire rare-earth permanent magnet, values of "a" and "b" of $R_aT_{(100-a-b)}C_b$ are shown.

TABLE 1

| | Compositional ratio of entire rare-earth permanent magnet | | | | | | | Compositional ratio of main phase | | | | |
|---|---|---|---|---|---|---|---|---|---|---|---|---|
| | Sm (at %) | Ce (at %) | Fe (at %) | Co (at %) | C (at %) | a (at %) | b (at %) | Sm (at %) | Ce (at %) | Fe (at %) | Co (at %) | C (c1) (at %) |
| Example 1 | 25.0 | 0.0 | 68.0 | 0.0 | 7.0 | 25.0 | 7.0 | 22 | 0 | 75 | 0 | 3 |
| Example 2 | 18.3 | 0.0 | 74.8 | 0.0 | 6.9 | 18.3 | 6.9 | 22 | 0 | 75 | 0 | 3 |
| Example 3 | 39.6 | 0.0 | 53.5 | 0.0 | 6.9 | 39.6 | 6.9 | 22 | 0 | 75 | 0 | 3 |
| Example 4 | 20.1 | 5.0 | 67.9 | 0.0 | 7.0 | 25.1 | 7.0 | 18 | 4 | 75 | 0 | 3 |
| Example 5 | 25.1 | 0.0 | 57.9 | 9.9 | 7.1 | 25.1 | 7.1 | 22 | 0 | 64 | 11 | 3 |
| Example 6 | 24.9 | 0.0 | 74.6 | 0.0 | 0.5 | 24.9 | 0.5 | 23 | 0 | 77 | 0 | 0 |
| Example 7 | 24.8 | 0.0 | 73.9 | 0.0 | 1.3 | 24.8 | 1.3 | 23 | 0 | 77 | 0 | 0 |
| Example 8 | 25.0 | 0.0 | 60.5 | 0.0 | 14.5 | 25.0 | 14.5 | 22 | 0 | 72 | 0 | 6 |
| Example 9 | 24.8 | 0.0 | 59.9 | 0.0 | 15.3 | 24.8 | 15.3 | 22 | 0 | 72 | 0 | 6 |
| Comparative example 1 | 25.0 | 0.0 | 74.8 | 0.0 | 0.2 | 25.0 | 0.2 | 23 | 0 | 77 | 0 | 0 |

TABLE 1-continued

| | | | | | | | | | | | | |
|---|---|---|---|---|---|---|---|---|---|---|---|---|
| Comparative example 2 | 17.3 | 0.0 | 75.7 | 0.0 | 7.0 | 17.3 | 7.0 | — | — | — | — | — |
| Comparative example 3 | 40.9 | 0.0 | 52.0 | 0.0 | 7.1 | 40.9 | 7.1 | — | — | — | — | — |
| Comparative example 4 | 25.0 | 0.0 | 68.0 | 0.0 | 7.0 | 25.0 | 7.0 | 22 | 0 | 75 | 0 | 3 |
| Example 10 | 24.5 | 0.0 | 69.6 | 0.0 | 5.9 | 24.5 | 5.9 | 22 | 0 | 76 | 0 | 1 |
| Example 11 | 23.8 | 0.0 | 72.3 | 0.0 | 3.9 | 23.8 | 3.9 | 23 | 0 | 77 | 0 | 0 |

| | Compositional ratio of grain boundary phase having higher concentration of R and C than in main phase | | | | | | Coercivity HcJ |
|---|---|---|---|---|---|---|---|
| | Sm (at %) | Ce (at %) | Fe (at %) | Co (at %) | C (c2) (at %) | c2 − c1 (at %) | (kA/m) |
| Example 1 | 41 | 0 | 39 | 0 | 20 | 17 | 3199 |
| Example 2 | 28 | 0 | 50 | 0 | 22 | 19 | 3032 |
| Example 3 | 52 | 0 | 29 | 0 | 19 | 16 | 3111 |
| Example 4 | 32 | 9 | 38 | 0 | 21 | 18 | 2984 |
| Example 5 | 40 | 0 | 33 | 6 | 21 | 18 | 3016 |
| Example 6 | 49 | 0 | 48 | 0 | 3 | 3 | 2467 |
| Example 7 | 47 | 0 | 46 | 0 | 7 | 7 | 2825 |
| Example 8 | 35 | 0 | 37 | 0 | 28 | 22 | 3040 |
| Example 9 | 36 | 0 | 32 | 0 | 32 | 26 | 2546 |
| Comparative example 1 | — | — | — | — | — | — | 1989 |
| Comparative example 2 | — | — | — | — | — | — | 1122 |
| Comparative example 3 | — | — | — | — | — | — | 1233 |
| Comparative example 4 | — | — | — | — | — | — | 2029 |
| Example 10 | 49 | 0 | 39 | 0 | 12 | 11 | 3223 |
| Example 11 | 47 | 0 | 37 | 0 | 16 | 16 | 3271 |

As for a production condition of the rare-earth permanent magnet according to Examples 2, 3, 6 to 9, and Comparative examples 1 to 3, a blending ratio of an R-T-C alloy was adjusted as shown in Table 1. Other conditions were same as Example 1.

As for a production condition of the rare-earth permanent magnet according to Example 4, a blending ratio of an R-T-C alloy was adjusted as shown in Table 1 and part of Sm was substituted by Ce. Other conditions were same as Example 1.

As for a production condition of the rare-earth permanent magnet according to Example 5, a blending ratio of an R-T-C alloy was adjusted as shown in Table 1 and part of Fe was substituted by Co. Other conditions were same as Example 1.

As for a production condition of the rare-earth permanent magnet according to Comparative example 4, a blending ratio of an R-T-C alloy was same as Example 1, but a heat treatment after the sintering step was not performed and cooled to room temperature, thereby the rare-earth permanent magnet was made.

As for a production condition of the rare-earth permanent magnet according to Example 10, it was same as Example 1 except that an R-T-C alloy used in Example 7 and an R-T-C alloy used in Example 9 were mixed and pulverized in a mass ratio of 2:1 during the fine pulverization step and used as finely pulverized powder.

As for a production condition of the rare-earth permanent magnet according to Example 11, it was same as Example 1 except that an R-T alloy produced to have 24 at % of Sm and 76 at % of Fe and an R-T-C alloy used in Example 9 were mixed and pulverized at a mass ratio of 4:1 during the fine pulverization step and used as finely pulverized powder.

For Examples 12 to 15, a compositional ratio of the entire rare-earth permanent magnet, a compositional ratio of the main phase, a compositional ratio of the grain boundary phase having higher concentration of R and C compared to the main phase, and a coercivity are shown in Table 1. Also, regarding the compositional ratio of the entire rare-earth permanent magnet, values of "a" and "b" of $R_aT_{(100-a-b)}C_b$ are shown.

TABLE 2

| | Compositional ratio of entire rare-earth permanent magnet | | | | | | | Compositional ratio of main phase | | | | |
|---|---|---|---|---|---|---|---|---|---|---|---|---|
| | Sm (at %) | Pr (at %) | Nd (at %) | Fe (at %) | C (at %) | a (at %) | b (at %) | Sm (at %) | Pr (at %) | Nd (at %) | Fe (at %) | C (c1) (at %) |
| Example 12 | 23.0 | 1.2 | 0.0 | 71.8 | 4.0 | 24.2 | 4.0 | 22 | 1 | 0 | 77 | 0 |
| Example 13 | 20.4 | 3.5 | 0.0 | 72.0 | 4.1 | 23.9 | 4.1 | 21 | 3 | 0 | 76 | 0 |
| Example 14 | 18.2 | 6.1 | 0.0 | 71.4 | 4.3 | 24.3 | 4.3 | 17 | 5 | 0 | 78 | 0 |
| Example 15 | 20.6 | 3.3 | 0.0 | 73.6 | 2.5 | 23.9 | 2.5 | 21 | 3 | 0 | 76 | 0 |
| Example 16 | 20.1 | 0.0 | 3.6 | 72.3 | 4.0 | 23.7 | 4.0 | 20 | 0 | 3 | 77 | 0 |

| | Compositional ratio of grain boundary phase having higher concentration of R and C than in main phase | | | | | | Coercivity HcJ |
|---|---|---|---|---|---|---|---|
| | Sm (at %) | Pr (at %) | Nd (at %) | Fe (at %) | C (c2) (at %) | c2 − c1 (at %) | (kA/m) |
| Example 12 | 44 | 2 | 0 | 39 | 15 | 15 | 3207 |
| Example 13 | 38 | 6 | 0 | 40 | 16 | 16 | 3159 |
| Example 14 | 33 | 10 | 0 | 40 | 17 | 17 | 3096 |

TABLE 2-continued

| | | | | | | | |
|---|---|---|---|---|---|---|---|
| Example 15 | 40 | 6 | 0 | 43 | 11 | 11 | 3119 |
| Example 16 | 39 | 0 | 6 | 39 | 16 | 16 | 3104 |

As for a production condition of the rare-earth permanent magnet according to Examples 12 to 14, it was same as Example 1 except that part of Sm was substituted by Pr so that an atomic ratio of Pr was 5 at % (Example 12), 15 at % (Example 13), and 25 at % (Example 14) with respect to the entire rare-earth element amount; and also an R-T alloy produced to have 24 at % of R and 76 at % of Fe and an R-T-C alloy used in Example 9 were mixed and pulverized at a mass ratio of 4:1 during a fine pulverization step and used as finely pulverized powder.

As for a production condition of the rare-earth permanent magnet according to Example 15, it was same as Example 1 except that part of Sm was substituted by Pr so that an atomic ratio of Pr was 15 at % with respect to the entire rare-earth element amount; and also an R-T alloy produced to have 24 at % of R and 76 at % of Fe and an R-T-C alloy used in Example 9 were mixed and pulverized at a mass ratio of 6:1 during a fine pulverization step and used as finely pulverize powder.

As for a production condition of the rare-earth permanent magnet according to Example 16, it was same as Example 1 except that part of Sm was substituted by Nd so that an atomic ratio of Nd was 15 at %; and also an R-T alloy formed to have 24 at % of R and 76 at % of Fe and an R-T-C alloy used in Example 9 were mixed and pulverized at a mass ratio of 4:1 during a fine pulverization step and used as finely pulverized powder.

Examples 1 to 9 and Comparative Examples 1 to 3

In Examples 1 to 9 and Comparative example 1, a main phase was an $R_5T_{17}$ crystal phase. It was confirmed that among these when the compositional ratio of R was within the range of larger than 18 at % and less than 40 at %, the compositional ratio of C was 0.5 at % or more and the phase having higher concentration of R and C compared to the main phase existed, and a high coercivity were able to obtain.

Examples 1, 6, and Comparative Example 1

In Comparative example 1, the gain boundary phase having higher concentration of R and C compared to the main phase was not observed; hence the compositional formula is not shown. The reason that the grain boundary phase having higher concentration of R and C compared to the main phase wasn't observed is thought because C was included in a ratio of 0.2 at % of the entire composition which was not enough, and C concentration in the grain boundary phase decreased thus the grain boundary phase having higher concentration of R and C compared to the main phase was not formed. As a result, it was not possible to attain a coercivity as high as Examples 1 and 6.

Examples 2 and 3 and Comparative Examples 2 and 3

In Comparative example 2, many α-Fe crystal phases were generated and the main phase was not an $R_5T_{17}$ crystal phase, thus the compositional ratio of the main phase and the compositional ratio of the grain boundary phase having higher concentration of R and C compared to the main phase are not shown. Since the compositional ratio of R was 18 at % or less, it is thought that an $R_5T_{17}$ crystal phase was difficult to form. As a result, in Comparative example 2, it was not possible to attain a coercivity as high as Example 2. In Comparative example 3, many $RT_2$ crystal phases were generated and the main phase was not an $R_5T_{17}$ crystal phase, thus the compositional ratio of the main phase and the compositional ratio of the grain boundary phase having higher concentration of R and C compared to the main phase are not shown. Since the compositional ratio of R was 40 at % or more, the ratio of $R_5T_{17}$ crystal phase decreased with respect to the entire rare-earth permanent magnet. As a result, in Comparative example 3, it was not possible to attain a coercivity as high as Example 3.

Examples 1 and Comparative Example 4

In Comparative example 4, the grain boundary phase having higher concentration of R and C compared to the main phase was not observed, thus the compositional ratio is not shown. It is thought that since the heat treatment was not performed after the sintering step and cooled to room temperature, C did not form a compound in the grain boundary phases and segregated. As a result, it was not possible to attain a coercivity as high as Example 1.

Example 4

In Example 4, since part of Sm was substituted by Ce, Ce existed both in the main phase and the grain boundary phase having higher concentration of R and C compared to the main phase. In this case, the grain boundary phase having higher concentration of R and C compared to the main phase was formed and high coercivity was obtained.

Example 5

In Example 5, since part of Fe was substituted by Co, Co existed both in the main phase and the grain boundary phase having higher concentration of R and C compared to the main phase. In this case, the grain boundary phase having higher concentration of R and C compared to the main phase was formed and high coercivity was obtained.

Examples 1 and 6 to 9

Examples 1, 7, and 8 had the compositional ratio of C within the range of $1.0<b<15.0$ with respect to the entire rare-earth permanent magnet. As a result, among Examples 1 and 6 to 9, a particularly high coercivity was attained in Examples 1, 7, and 8. It is thought that since the compositional ratio of C was larger than 1.0 at %, the ratio of the grain boundary phase having higher concentration of R and C compared to the main phase occupying the entire grain boundary phases increased, and also since the compositional ratio of C was less than 15.0 at %, the ratio of the grain boundary phase having higher concentration of R and C compared to the main phase with respect to the main phase was within the appropriate range.

Examples 1, 7, 10, and 11

In Examples 7, 10, and 11, the compositional ratio of C in the main phase was less than 3 at %. Among Examples 7, 10, and 11, a particularly high coercivity was attained in Examples 10 and 11 in which a difference between a compositional ratio in the main phase and a compositional ratio of C in the phase having higher concentration of R and C compared to the main phase was 10 at % or larger. Also, in Examples 1, 10, and 11, the difference between a compositional ratio in the main phase and a compositional ratio of C in the phase having higher concentration of R and C was 10 at % or more. Among Examples 1, 10, and 11, a particularly high coercivity was attained in Examples 10 and 11 in which the compositional ratio of C in the main phase was less than 3 at %. It is thought that a magnetic anisotropy of the main phase was suppressed from decreasing since the compositional ratio of C in the main phase was sufficiently low, and also since a difference between the compositional ratio in the main phase and the compositional ratio of C in the phase having higher concentration of R and C compared to the main phase was large enough, an effect of a magnetic separation between the main phase grains was attained in addition to an effect of pinning the magnetic domain wall movement in the grain boundaries.

Examples 12 to 16

In Examples 12 to 16, an alloy in which part of R was substituted by Pr or Nd was used as a raw material, and during a crystallization treatment or a sintering step, Sm and also Pr or Nd were diffused, thus Pr or Nd existed in both the main phase and the grain boundary phase having higher concentration of R and C compared to the main phase. In this case, the grain boundary phase having higher concentration of R and C compared to the main phase was formed, thus a high coercivity was attained.

What is claimed is:

1. A rare-earth permanent magnet comprising a main phase having an $Nd_5Fe_{17}$ crystal structure, wherein a compositional ratio of the rare-earth permanent magnet is represented by $R_aT_{(100-a-b)}C_b$, where:

R is Sm or is at least one selected from rare earth elements in addition to Sm,

T is Fe or a combination of Fe and Co or is at least one selected from transition metal elements in addition to Fe or the combination of Fe and Co, and "a" and "b" satisfy $18<a<40$ and $0.5\leq b$, a phase having a higher concentration of R and C compared to the main phase is included in grain boundary phases of the rare-earth permanent magnet, $c1<3.0$ at % and $c2-c1>10.0$ at % are satisfied, where c1 (at %) represents a compositional ratio of C in the main phase and c2 (at %) represents a compositional ratio of C in the phase having the higher concentration of R and C compared to the main phase, and the rare-earth permanent magnet is a rare-earth sintered magnet.

2. The rare-earth permanent magnet according to claim 1, wherein "b" satisfies $1.0<b<15.0$.

* * * * *